US006749228B2

(12) United States Patent
Takemura

(10) Patent No.: US 6,749,228 B2
(45) Date of Patent: Jun. 15, 2004

(54) ROBUST SUPPORTED DISPLAY FOLDER

(75) Inventor: Shun Takemura, Pacific Palisades, CA (US)

(73) Assignee: Itoya of America, Ltd., Torrance, CA (US)

( * ) Notice: Subject to any disclaimer, the term of this patent is extended or adjusted under 35 U.S.C. 154(b) by 292 days.

(21) Appl. No.: 10/093,551

(22) Filed: Mar. 8, 2002

(65) Prior Publication Data

US 2003/0168848 A1 Sep. 11, 2003

(51) Int. Cl.[7] ..... A47B 23/00
(52) U.S. Cl. ..... 281/33; 402/73
(58) Field of Search ..... 402/73, 80 P, 502; 281/15.1, 33; 248/441.1, 447, 460; 283/61

(56) References Cited

U.S. PATENT DOCUMENTS 1,577,697 A * 3/1926 James ..... 402/70
3,091,482 A * 5/1963 Caesar ..... 281/33
4,314,625 A * 2/1982 Sarna et al. ..... 190/16
4,880,327 A * 11/1989 Sanabria ..... 402/73
4,981,386 A * 1/1991 Beleckis ..... 402/73
5,149,047 A * 9/1992 Tucker ..... 248/459

* cited by examiner

*Primary Examiner*—Derris H. Banks
*Assistant Examiner*—Jamila Williams
(74) *Attorney, Agent, or Firm*—Squire, Sanders & Dempsey, LLP

(57) ABSTRACT

A display device such as a folder, binder or book includes transparent envelope pages for display of material and a support that is deployable to brace the covers of the device inside out in a triangular configuration that is capable of supporting relatively heavy displays from the apex of the triangle so formed.

20 Claims, 5 Drawing Sheets

ROBUST SUPPORTED DISPLAY FOLDER

BACKGROUND OF THE INVENTION

Many different kinds of portfolios, display binders, books, and folders exist, which hereinafter will be referred to generally as folders. Some well known types include three ring binders, spiral-bound notebooks and clasped folders. These are used to retain individual sheets, usually of paper, so that they can viewed as if they were bound in a book. Sometimes clear envelopes are included to retain and protect flat items for later display or study. These retained items typically include warranties, magazine clippings, reports and graphs, certificates, legal documents, photographs and negatives, collectible stamps and any other flat items including pressed flowers or other organic samples, where clear, usually plastic, envelopes can provide safe storage and display. When relatively bulky items are to be stored and displayed, it is desirable to provide some sort of positive closure so that the display pages are protected by the relatively stiff outer binding, yet it is desirable that the folder itself is lightweight and is constructed from relatively economical single sheet materials, such as plastic.

When what is stored within the pages of such a folder is heavy, deformation of the folder leading to collapse can be troublesome especially when such collapse happens at a particularly serious portion of a presentation when laughter is not appropriate. Therefore, there is a need for lightweight, yet robust folders, especially those of the three ring type include index pages, constructed from relatively lightweight and flexible materials that can be formed into a support for display of the contents thereof which when so formed, is structurally rigid material yet when not so formed is a light protective folder, with positive closure.

SUMMARY OF THE INVENTION

The present invention is a display folder having covers which surround a plurality of transparent display envelopes. The display folder may have three or four sheet sides and is configurable into supported triangular structure so that relatively heavy displays can be shown. When in its triangular display position a support folds down to engage the base of the triangle and maintain the triangular shape. The transparent display envelopes are supported at the apex of the triangle and flipped over the top. If it is desired to display on both sides of the folder, the display envelopes may have identical facing displays so that when the envelopes are flipped over the top of the triangle the same display appears on both sides of the folder. The covers wrap around the display envelopes to securely protect them and optional fastening devices can be provided to assure that the covers remain about the display envelopes when not on display.

Therefore, it is an object of the present invention to provide a relatively light weight and economical display folder which is easily deployed into a robust stand, which is self-supporting on a horizontal surface.

Another object is to provide a display folder with positive fasteners to assure that the covers of the folders remain around the displays when such are desired.

Another object is to provide a display folder which is relatively economical to manufacture so that it can be sold at prices competitive to non-display folders.

These and other objects and advantages of the present invention will become apparent to those skilled in the art after considering the following detailed specification and drawings wherein:

DETAILED DESCRIPTION OF THE SHOWN EMBODIMENT

Figure 1:
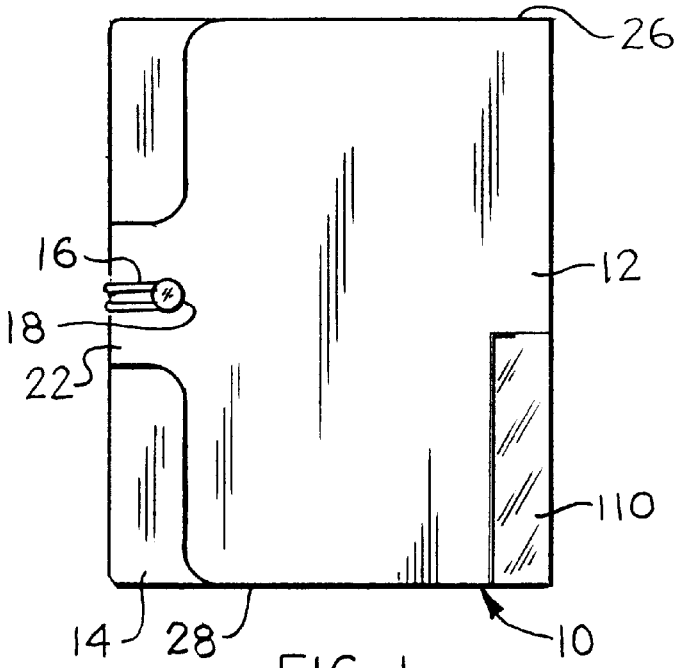
FIG. 1 is a front elevational view of a folder constructed in accordance with the present invention showing how, when looped around a button, an elastic cord holds the covers of the folder together about display pages.

Referring to the Figures more particularly by reference numbers. Number 10 in FIG. 1 where first to a display folder constructed in accordance with the present invention. As can be seen in FIG. 1, the front cover 12 is releasably retained to an inner cover 14 by elastic cord 16 and a button 18 attached to the first cover 12.

Figure 2:
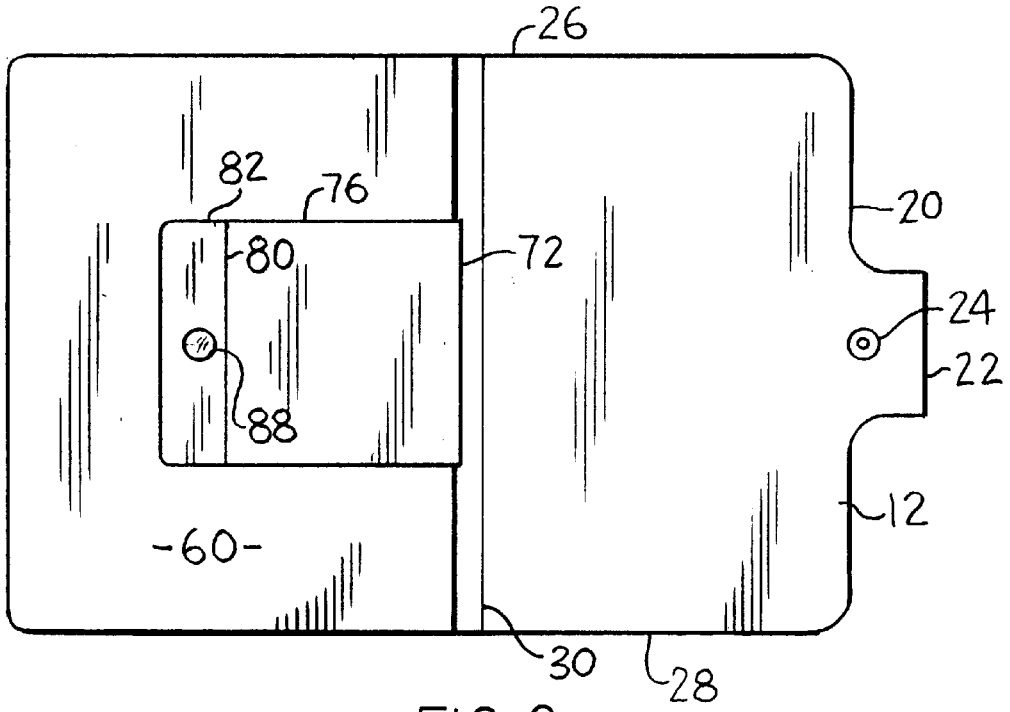
FIG. 2 is a outside elevational view of the folder of FIG. 1 with the front cover folded flat to the back.
Figure 3:
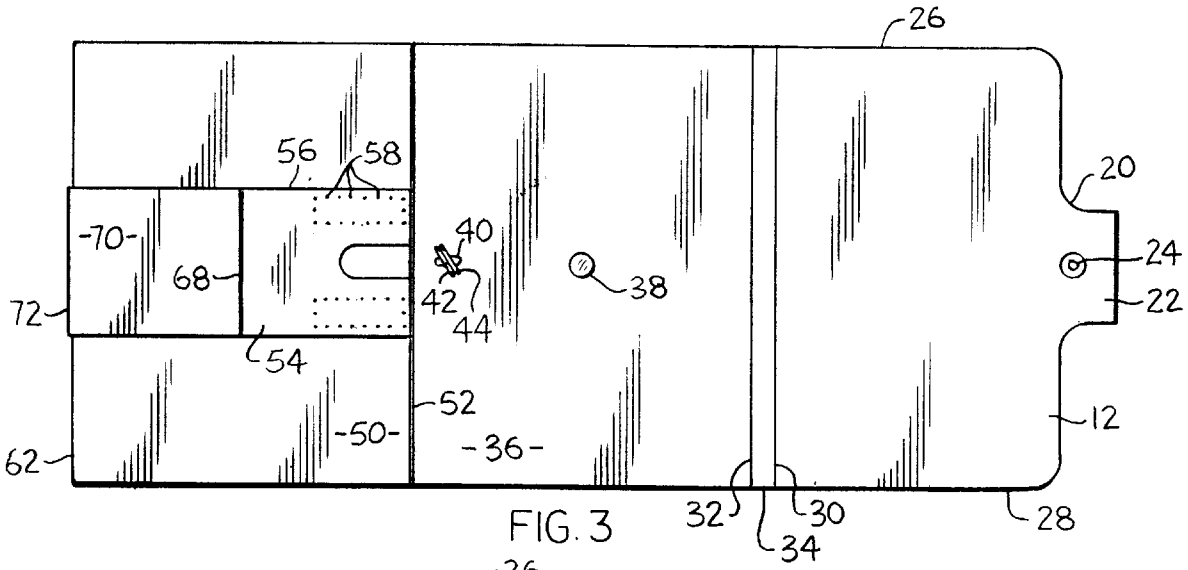
FIG. 3 is a front elevational view of the folder of FIGS. 1 and 2 unfolded more so that three covers of the display are shown.

In FIGS. 2 and 3, the front cover 12 has been unfolded to clearly show that its outer edge 20 includes a tab 22 with the underside 24 of the button 18 being adjacent the tab 22 and centrally located between the sides 26 and 28 of the display folder 10. The front cover 12 is connected by two folds 30 and 32 about an optional spacer 34 provided so that the folder 10 can surround itself while its covers remain generally planar. The back cover 36, which becomes the bottom of the display folder 10 when deployed for display, includes a second button 38 generally centrally located therein for releasable attachment to a support that will described hereinafter. The back cover 36 also includes a hole 40 through which the elastic cord 16 is threaded with the elastic cord 16 either being tied or having T shaped retainers 42 and 44 on the ends thereof to secure it to the back cover 36.

Figure 4:
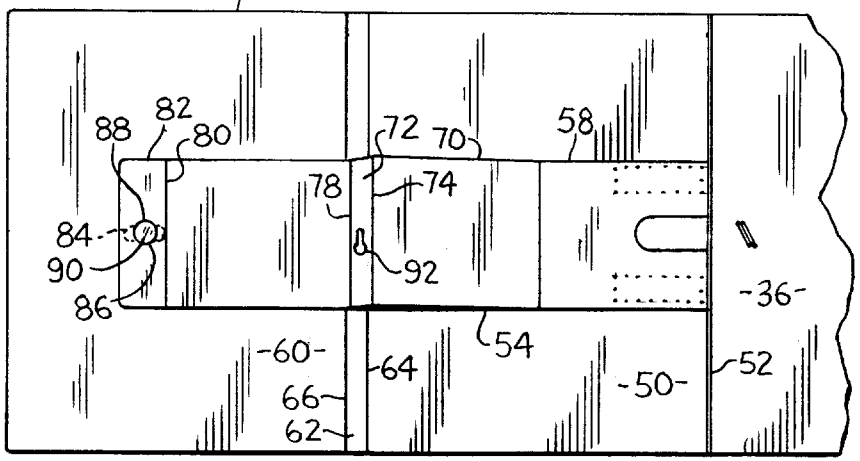
FIG. 4 is a partial outside elevational view of the folder of FIGS. 1, 2, and 3 unfolded more so that the third and fourth covers, a portion of the second cover, and the support for the display are shown.

The back cover 36 is connected to an inner cover 50 by a fold 52 and has one end 54 of a support 56 fixedly attached thereto such is by the heat weld 58 shown. In FIG. 4, the second inner cover 60 has been swung from behind the first inner cover 50. The second inner cover 60 is connected to the first inner cover 50 by a spine 62, which forms the attachment for the display pages and two folds 64 and 66.

As can be seen, a fold 68 attaches a first support portion 70 of the support 56 to the fixed end 54 which in turn is connected to a base 72 by a fold 74 and thereon to a second support portion 76 by a fold 78. A fold 80 connects the support portion 76 to a slidable connection 82 which is attached to the second inner cover 60 by means of a slot 84 and a fastener 86. The head 88 of the fastener 86 is larger than the width of the slot 84 so that the shank 90 of the fastener 86 can slide slightly in the slot 84, providing enough movement capability so that the cover 60 can be folded back behind the cover 50 without over stressing the support 54. The base 72 includes a key hole shaped slot 92 for releasably affixing over the button 38 when the folder 10 is assembled into a triangular configuration.

Figure 5:
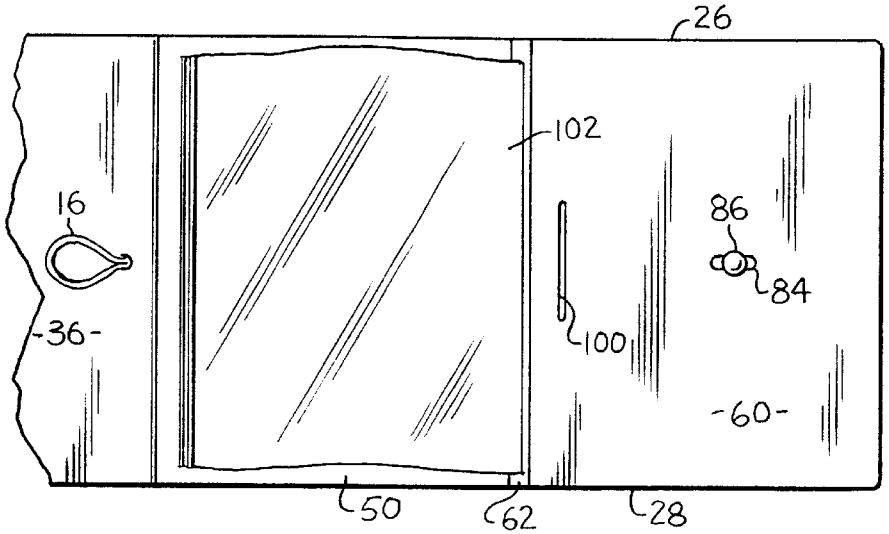
FIG. 5 is a partial inside elevational view of the folder of FIGS. 1, 2, and 3 showing the display pages thereof.

In FIG. 5, the slot 84 in the second inner cover 60 is more easily seen. In addition, in FIG. 5, a tab receiving slot 100 can be seen, as well as a plurality of display envelopes 102 which are connected to the spine 62 of the folder 10. Although the connection shown is a plastic weld, the spine 62 may include other commonly used page fastening systems such as three binder rings, page clamps or bendable fasteners.

Figure 6:
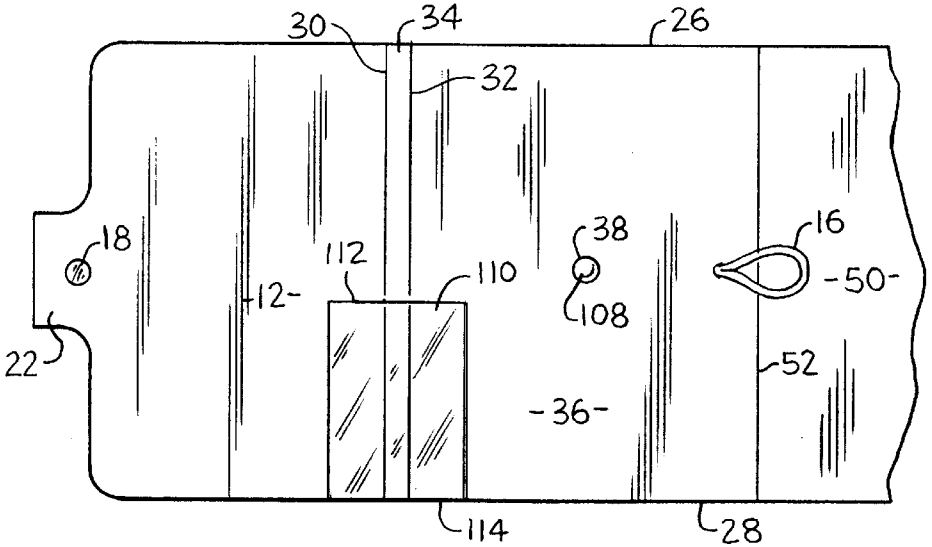
FIG. 6 is a partial inside elevational view of the folder similar to FIG. 5 showing the front and back covers thereof.

In FIG. 6, the back side 108 of the fastener 38 can be seen, as well as, a transparent label attachment 110, which extends from cover 12 to cover 36 around spacer 34. Normally, either edge 112 or edge 114 of the transparent piece 110 is open so that a suitable label can be inserted therein.

Figure 7:
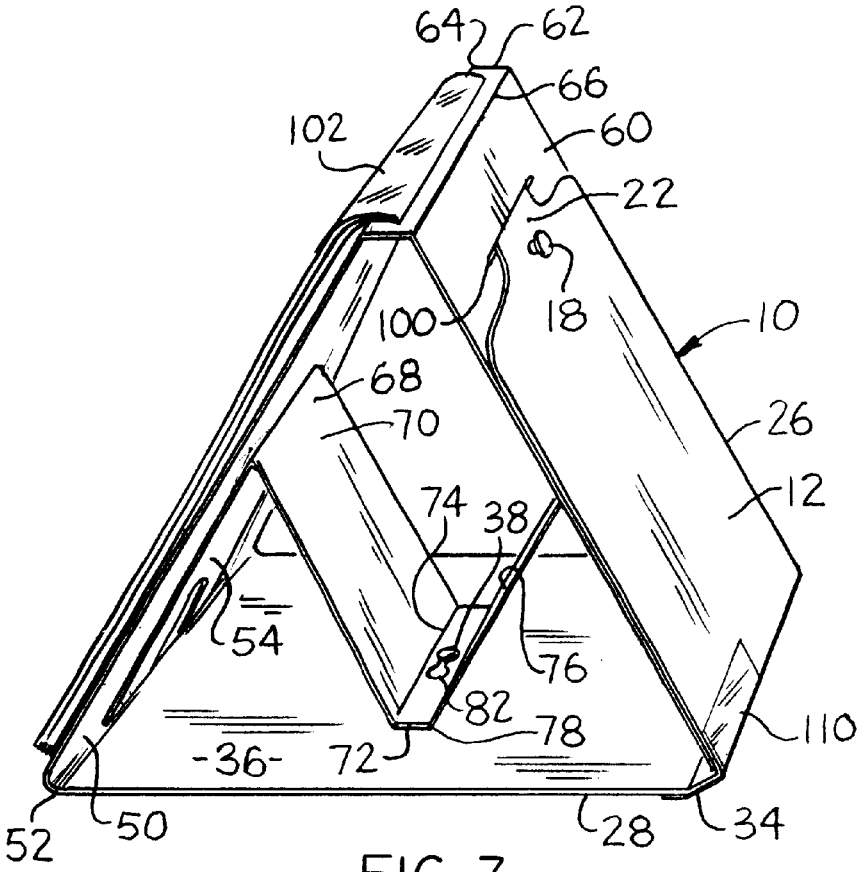
FIG. 7 is an perspective view of the folder showing it configured as a display.
Figure 8:
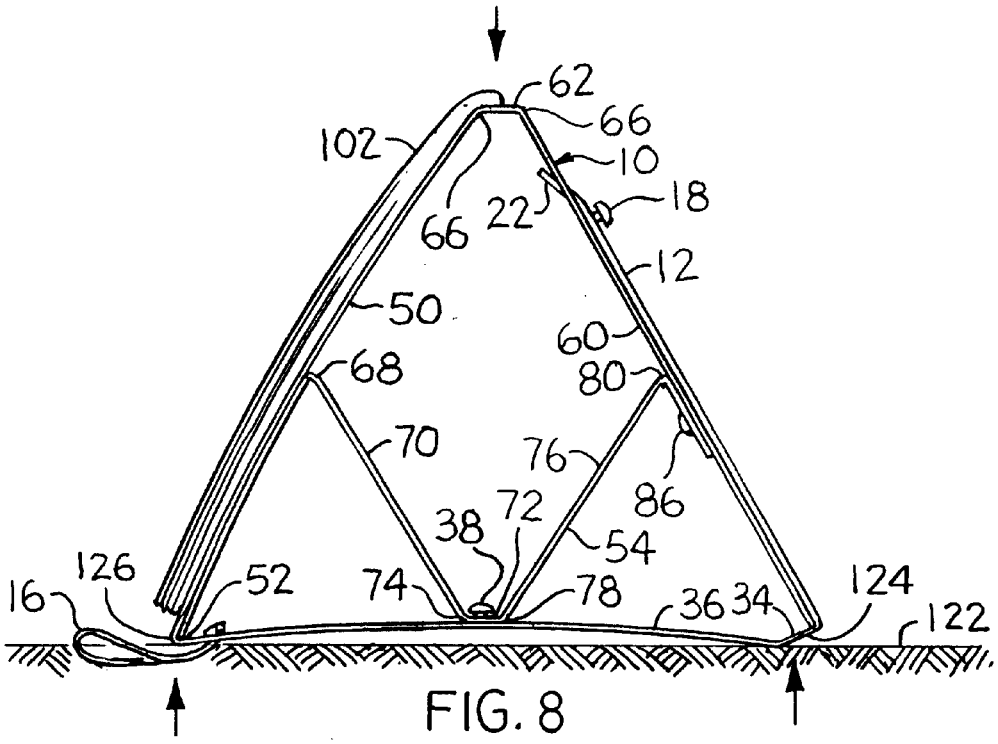
FIG. 8 is a side elevational view of the folder showing how downward load of the display pages is transferred throughout the folder.

FIG. 7 shows the display folder 10 in its display configuration with a tab 22 inserted into the slot 100 to establish a triangular configuration and a key hole slot 92 in the base 72 hooked onto the fastener 38 to connect the support 54 to the cover 36. As shown in FIG. 8, when downward force shown by the arrow 120, is applied to the folder 10 in its triangular configuration as is typical when the display envelopes 102 contain relatively heavy material, the force is transferred to a horizontal surface 122 at the lower corners 124 and 126 of the triangle. This force tends to spread the now upright covers 50 and 60 apart which causes the support 54 to pull up on the cover 36 resulting in an extremely robust and stiff structure.

Figure 9:
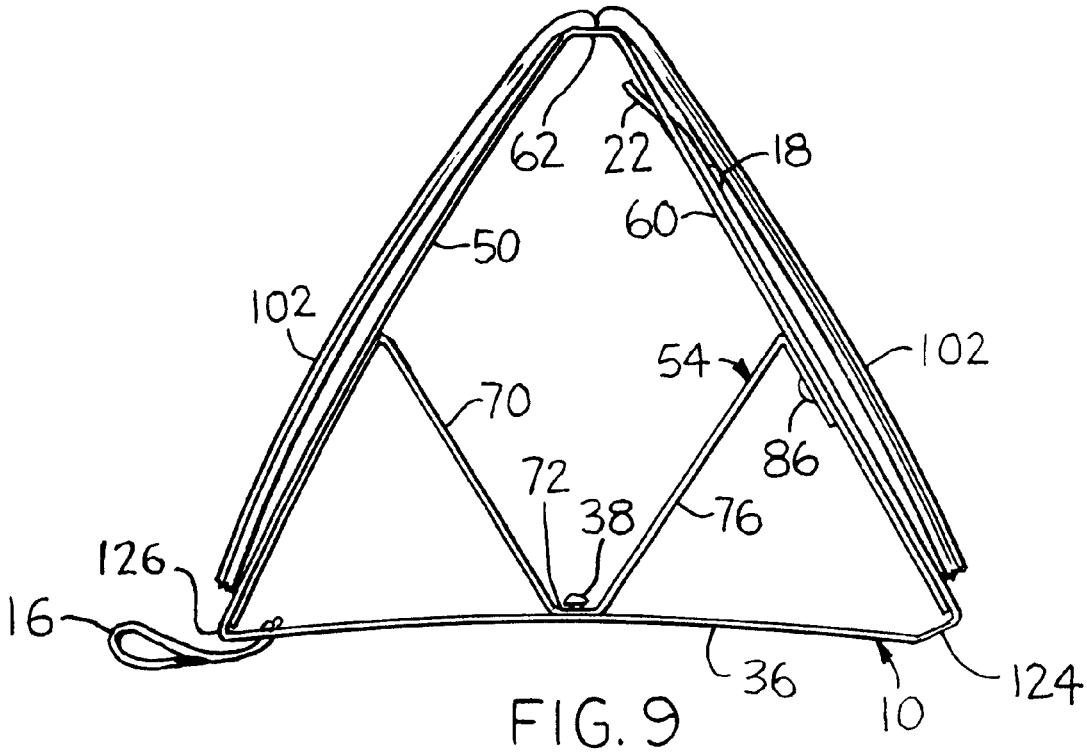
FIG. 9 is a side elevational view of the folder similar to FIG. 8 with a number of display pages flipped over to the back thereof and showing how the folder can be used as a double sided display.

As shown in FIG. 9, the folder 10 allows the envelopes 102 to be flipped over the spine 62. If identical images are contained in facing envelope sides, then the display folder 10 can display the same material in opposite directions.

Thus, there has been shown and described a robust display folder which fulfills all of the objects and advantages sought therefore. Many changes, alterations, modifications, and other uses and applications of the subject invention, become apparent to those skilled in the art after considering the specification together with the accompanying drawings. All such changes, alterations, and modifications which do not depart from the spirit and scope of invention are deemed to be covered by the invention, which is limited only by the claims that follow.

What is claimed is:

1. A display device comprising:

a generally planar first cover;

a generally planar second cover connected for folding to said first cover;

a generally planar third cover connected for folding to said second cover;

a first spine for connecting to a plurality of display sheets, said first spine being connected for folding to said generally planar third cover;

a generally planar fourth cover connected for folding to said first spine;

a first releasable connection for connecting said first and fourth generally planar covers;

a support connected to said third and fourth generally planar covers; and a second releasable connection for connecting said support to said generally planar second cover.

2. The display device as defined in claim 1 wherein said support, when connected to said generally planar second cover, extends at angles from said third and fourth generally planar covers.

3. The display device as defined in claim 2 wherein said support includes:

a first support portion having:

a first folding connection to said fourth generally planar cover;

a second support portion having:

a second folding connection to said third generally planar cover; and a base portion which is releasably connected to said generally planar second cover by said second end releasable connection, said base portion having:

a third folding connection to said first support portion; and a fourth folding connection to said second support portion.

4. The display device as defined in claim 3 wherein said generally planar second cover includes:

a button, and wherein said base portion includes:

a button retaining slot, said button and said button retaining slot being portions of said second releasable connection, whereby when said button and said button retaining slot are engaged, a releasable connection is formed between said base portion and said generally planar second cover.

5. The display device as defined in claim 1 wherein said first releasable connection for connecting said first and fourth covers includes:

a slot in said fourth cover; and a slot engaging tab formed on said first cover.

6. The display device as defined in claim 5 wherein said generally planar first cover includes:

a button adjacent said slot engaging tab, and wherein said generally planar second cover includes:

an elastic loop adjacent said generally planar third cover, whereby when said covers are wrapped around each other to protect any display sheets, said elastic loop can be engaged with said button to retain said display device closed.

7. The display device as defined in claim 6 further including:

a second spine positioned between said first and second generally planar covers to provide room for said other covers and any contents of said display device when said covers are wrapped around each other, said second spine including:

a transparent indicia holder about at least an exterior portion thereof.

8. The display device as defined in claim 1 further including:

a plurality of display sheets in the form of transparent envelopes operatively connected for leafing to said first spine.

9. The display device as defined in claim 1 wherein said support includes:

a loose connection to at least one of said third and fourth generally planar covers, said loose connection including:

a fastener with:

a head; and a shank; and a slot having:

a width larger than said shank and smaller than said head.

10. A display device comprising:

a first cover;

a second cover connected for folding to said first cover;

a spine for connecting to a plurality of display sheets, said spine being connected for folding to said second cover;

a third cover connected for folding to said spine;

a first releasable connection for connecting said first and third covers;

a folding support connected to said second and third covers; and a second releasable connection for connecting said support to said first cover, whereby when said folding support is connected to said first cover, said first, second, and third covers generally form a triangular shape.

11. The display device as defined in claim 10 wherein said folding support, when connected to said first cover, extends at angles from said second and third covers.

12. The display device as defined in claim 11 wherein said folding support includes:

a first support portion having:

a first folding connection to said third cover;

a second support portion having:

a second folding connection to said second cover; and a base portion for connecting to said first cover and having:

a third folding connection to said first support portion; and a fourth folding connection to said second support portion.

13. The display device as defined in claim 12 wherein said second cover includes:

a button, and wherein said base portion includes:

a button retaining slot, thereby when said button and said button retaining slot are engaged, a connection is formed between said base portion and said second cover.

14. The display device as defined in claim 10 further including:

a plurality of display sheets in the form of transparent envelopes operatively connected for leafing to said spine.

15. A folder for displaying items in a plurality of envelopes that have at least one transparent side, the folder including:

an elongate unitary cover sheet having:

a first end portion including:

a first releasable fastening system, first part;

a first interior portion connected to said first end portion by at least one first fold line, said first interior portion including:

a second releasable fastening system, first structure;

a second interior portion connected to said first interior portion by at least one second fold line;

a second end portion connected to said second interior portion by at least one fold line, said second end portion including:

a second part of said first releasable fastening system; and a folding support that extends between three adjacent portions of said elongate unitary cover sheet and includes:

a second structure of said second releasable fastening system that when connected to said second releasable fastening system first structure releasably retains said elongate unitary cover sheet in a triangular configuration.

16. The folder as defined in claim 15 wherein said first side of said first releasable fastening system includes:

a tab extending from said first end portion opposite said first interior portion, and wherein said second part of said first releasable fastening system includes:

a slot formed in said second end portion.

17. The folder as defined in claim 15 wherein said folder when supported in the triangular configuration includes:

three corners, said folder including:

display envelopes connected to one of said corners.

18. The folder as defined in claim 15 wherein said folding support includes:

first and second connections to said second interior portion and said second end portion; and first and second support portions foldably connected to said first and second connections respectively.

19. The folder as defined in claim 18 wherein said first connection includes:

a loose connection to allow relative movement between said first connection and said connected cover sheet portion.

20. The folder as defined in claim 19 wherein said loose connection includes:

an elongate hole as one portion of said loose connection; and a headed fastener positioned through said elongate hole as a second portion of said loose connection.

* * * * *